United States Patent [19]

Schultz

[11] 4,026,501

[45] May 31, 1977

[54] CARRIER

[75] Inventor: Edward J. Schultz, San Diego, Calif.

[73] Assignee: The Raymond Lee Organization, Inc., New York, N.Y. ; a part interest

[22] Filed: Dec. 29, 1975

[21] Appl. No.: 644,622

[52] U.S. Cl. ..... 224/45 R; 224/45 N; 211/13

[51] Int. Cl.[2] ..... B65D 71/00

[58] Field of Search ..... 224/52, 49, 55, 45 R, 224/48 R, 45 N, 45 M; 235/1 R; 206/45.14; 248/499; 108/28, 50; 211/13

[56] References Cited

UNITED STATES PATENTS

| | | | |
|---|---|---|---|
| 188,199 | 3/1877 | Smith | 224/45 N |
| 2,688,408 | 9/1954 | Binggely | 211/13 |
| 2,733,113 | 1/1956 | Humbargar | 211/13 |
| 2,907,507 | 10/1959 | Solak | 224/45 R |
| 3,295,733 | 1/1967 | Heal | 224/45 N |
| 3,942,636 | 3/1976 | Matsuyama et al. | 224/55 |

*Primary Examiner*—Robert G. Sheridan
*Assistant Examiner*—Kenneth Noland
*Attorney, Agent, or Firm*—Howard I. Podell

[57] ABSTRACT

An improved carrier particularly adaptable for carrying an article such as a typewriter. The carrier is in the form of a sheet of semi-rigid plastic or lightweight metal material bent as an L-shaped section and fitted with a pair of straps that mount about the space enclosed by the arms of the sheet, with each loose strap end fitted with a tab of Velcro type fastening material that engages a mating tab of Velcro material fixed to the underside of the sheet. The base arm section of the sheet may be formed with a plurality of spaced holes located to engage the legs of a typewriter or other business machine resting on the base arm section, and the handle arm section is fitted with a hand hold opening along its upper edge.

2 Claims, 4 Drawing Figures

CARRIER

SUMMARY OF THE INVENTION

My invention is an improved carrier particularly adaptable for carrying an article such as a typewriter. The carrier is in the form of a sheet of semi-rigid plastic or lightweight metal material bent as an L-shaped section and fitted with a pair of straps that mount about the space enclosed by the arms of the sheet, with each loose strap end fitted with a tab of Velcro type fastening material that engages a mating tab of Velcro material fixed to the underside of the sheet. The base arm section of the sheet may be formed with a plurality of spaced holes located to engage the legs of a typewriter or other business machine resting on the base arm section, and the handle arm section is fitted with a hand hold opening along its upper edge.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
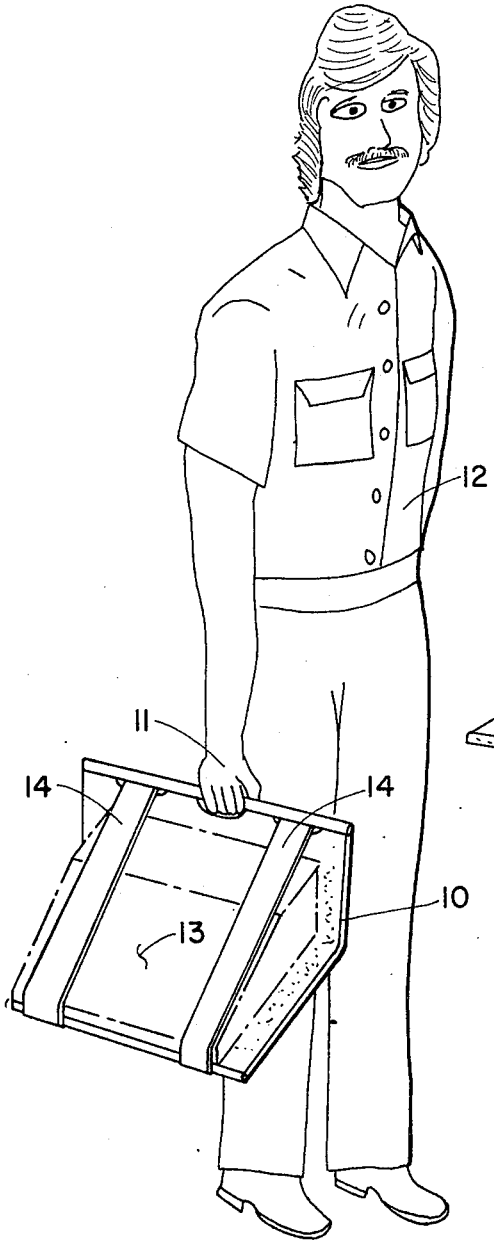
FIG. 1 is a perspective view of the invention in use.
Figure 2:
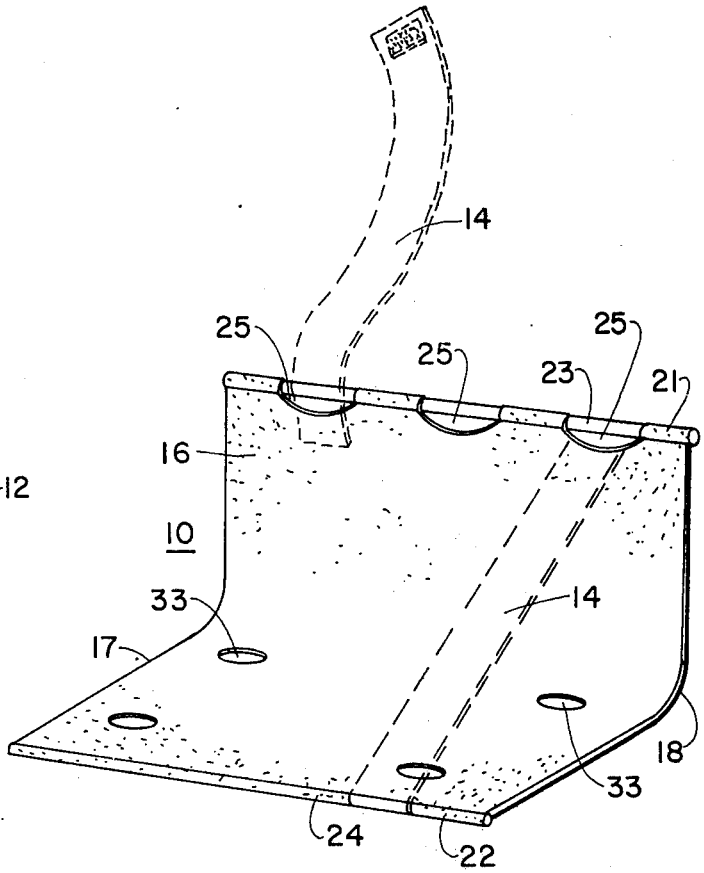
FIG. 2 is a perspective view of the invention.
Figure 3:
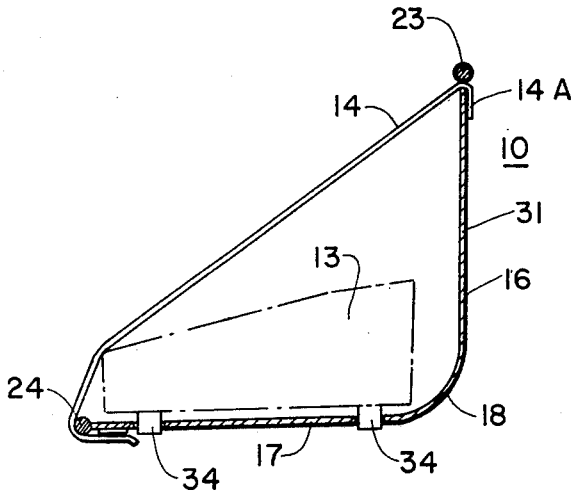
FIG. 3 is a sectional view of the invention.
Figure 4:
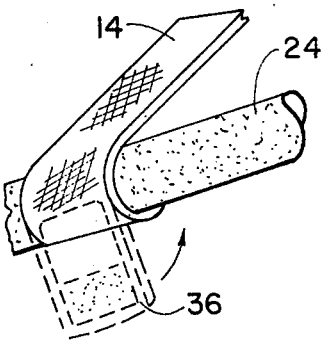
FIG. 4 is a fragmentary detail view of the invention.

Turning now descriptively to the drawings, in which similar reference characters denote similar elements throughout the several views, FIGS. 1–3 illustrate the carrier 10 which may be readily grasped by the hand 11 of a user 12 to hold a typewriter 13 or other business machine which is gripped by a pair of straps 14.

Carrier 10 is formed of a sheet of semi-rigid plastic or lightweight metal bent to form an L-shaped unit with a vertical handle arm member 16 joined to a horizontal base arm member 17 by a curved section 18. The external end edge sections 21 and 22 of the arm members 16 and 17 are joined to rods 23 and 24 respectively that extend across the width of the arm members, with edge sections 21 and 22 rolled to form cylindrical lips, which enclose rods 23 and 24 respectively as shown in FIG. 2.

Three openings 25 are located in vertical handle arm member 16 adjacent to rod 23 with center opening 25 of a size to permit the hand of a user to grasp rod 23 and a flexible strap 14 passing through each of the other two openings 25 with a strap end 14A fixed to the back surface 31 of arm member 16 and each strap 14 extending through opening 25 so as to wrap over a typewriter 13 resting on base 17 and detachably fasten to the undersurface 32 of base member 17.

Four holes 33 are formed in base member 17, located to engage the four legs 34 of a typewriter 13 resting on base member 17.

Each free strap end 36 is fixed on its undersurface 37 with a section of Velcro type adhering tab 39 which engages a mating Velcro tab 41 for detachably fastening strap 14 to base member 17, with Velcro tabs 39 and 41 of a length to permit adjustment of the fastened length of strap 14 about a typewriter 13.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A carrier adaptable for transporting a typewriter in its normal position of use, said carrier formed of a flat sheet of material bent as an L-shape, in section, to form a flat base plate extending generally perpendicularly to a flat handle plate, said base plate of a size to extend under and beyond the periphery of a typewriter, the bottom of which rests on said base plate, with said handle plate of a size to extend upwardly behind and beyond the periphery of the rear side of a typewriter resting on said base plate, with a plurality of uniform size holes formed in said base plate and located to each individually engage of leg of a typewriter resting on said base plate, and with a hole formed in the handle section to serve as a hand grip means, a pair of flexible straps, each fixed about the upper edge of the handle plate and of a length to extend about and engage the top of a typewriter resting on said base plate, the legs of which typewriter are engaged in said holes in the base plate, so that an end of each of said straps may be bent over an edge of the base plate to detachably fasten to the underside of the base plate, together with detachable mating fastening means fixed to the end of each of said straps and the underside of said base plate.

2. The combination as recited in claim 1 in which the mating fastening means are strips of velcro type material.

* * * * *